US005185612A

United States Patent [19]

Tsukada et al.

[11] Patent Number: 5,185,612

[45] Date of Patent: Feb. 9, 1993

[54] ANTENNA ON VEHICLE REAR WINDOW GLASS

[75] Inventors: Tokio Tsukada; Yoji Nagayama; Junichiro Ieiri, all of Matsusaka, Japan

[73] Assignee: Central Glass Company, Ltd., Ube, Japan

[21] Appl. No.: 737,208

[22] Filed: Jul. 30, 1991

[30] Foreign Application Priority Data

Jul. 30, 1990 [JP] Japan ..... 2-202291

[51] Int. Cl.[5] ..... H01Q 1/32

[52] U.S. Cl. ..... 343/713

[58] Field of Search ..... 343/713, 704

[56] References Cited

U.S. PATENT DOCUMENTS

| | | | |
|---|---|---|---|
| 4,260,989 | 4/1981 | Ishii et al. | 343/713 |
| 4,439,771 | 3/1984 | Kume et al. | 343/713 |
| 4,608,570 | 8/1986 | Inaba et al. | 343/713 |
| 4,954,797 | 9/1990 | Shinnai et al. | 343/704 |

FOREIGN PATENT DOCUMENTS

| | | |
|---|---|---|
| 61-121603 | 6/1986 | Japan . |
| 61-203072 | 9/1986 | Japan . |

*Primary Examiner*—Rolf Hille

*Assistant Examiner*—Hoanganh Le

*Attorney, Agent, or Firm*—Keck, Mahin & Cate

[57] ABSTRACT

The invention relates to an antenna on a vehicle rear window glass for the reception of FM radio broadcasting and TV broadcasting in both the VHF and UHF bands. The window glass is provided with defogging heater strips, and the antenna uses a space left above the heater strips. The antenna is essentially comprised of an L-shaped primary element with a vertical part on or close to the vertical center axis of the window glass and a horizontal part extending from the lower end of the vertical part, an impedance matching element located on one side of the vertical part of the primary element and an auxiliary element extending horizontally above the impedance matching element. The impedance matching element has two parallel horizontal parts, at least one vertical part connecting the two horizontal parts to each other and two extensions which extend vertically from the two horizontal parts, respectively, and bend to connect to the vertical part of the primary element. The auxiliary element is connected at one end thereof to the vertical part of the primary element directly or via a portion of the impedance matching element. The other end of the auxiliary element is connected to a feed point located near to a side edge of the window glass.

26 Claims, 3 Drawing Sheets

ANTENNA ON VEHICLE REAR WINDOW GLASS

BACKGROUND OF THE INVENTION

This invention relates to an antenna provided to a vehicle rear window glass for receiving FM radio and television (TV) broadcast waves, the antenna being constructed of conductive strips attached to the window glass by using a space above defogging heater strips. The antenna is particularly suited to automobiles.

In the automobile industry recently attention has been paid to a so-called window glass antenna for receiving radio broadcast waves, and there is an increasing demand for a window glass antenna which can efficiently receive both FM radio broadcast waves and TV broadcast waves. To meet such a demand there are several proposals.

For example, JP 61-203702 A proposes a windshield antenna having, as an essential element, a linear element which extends vertically in the central region of the windshield, and JP 61-121603 A proposes a rear window glass antenna which is arranged in a space left above an array of defogging heater strips and includes two feed points which are connected to two different points of an antenna element, respectively.

However, in the case of providing an antenna in a central region of the windshield the driver's field of view is inevitably obstructed.

In the case of providing an antenna to an automobile rear window glass which needs to be provided with defogging heater strips, the antenna must be arranged in a relatively narrow space contiguous to an edge of the window glass since a central region is occupied by the heater strips. That is, the antenna nears the metal body of the car which is regarded as the ground. By reason that the allowed space is narrow and off-centered it is difficult to construct an antenna which exhibits high reception gain over a wide range of frequency including the FM radio broadcasting bands and both the VHF and UHF bands for TV broadcasting.

SUMMARY OF THE INVENTION

Concerning a vehicle rear window glass, in particular an automobile rear window glass, which is provided with a set of defogging heater strips, it is an object of the present invention to provide a window glass antenna which can be arranged by utilizing a relatively narrow space between the defogging heater strips and the upper edge of the window glass and can receive FM radio broadcast waves and TV broadcast waves in both the VHF band and the UHF band with sufficiently high gain.

We have succeeded in accomplishing the above object by employing, as the main antenna element, an L-shaped element with a vertical part on or in the vicinity of a vertical center axis of the window glass and a horizontal part extending from the lower end of the vertical part, combining this main element with an impedance matching element of a specific construction positioned on one side of the vertical part of the main element and an auxiliary element which extends horizontally above the impedance matching element, and positioning a feed point at a short distance from a side edge of the window glass and connecting the main element with the feed point via the auxiliary element.

More definitely the present invention provides an antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in that space and comprising an L-shaped primary element having a vertical part positioned in a widthwise central area of the aforementioned space and a horizontal part which extends from the lower end of the vertical part, an impedance matching element which is located in an area between the vertical part of the primary element and a side edge of the window glass, an auxiliary element having a horizontal part which extends above the impedance matching element from the aforementioned central area to a marginal area contiguous to the aforementioned side edge of the window glass and a feed point located in the marginal area. The impedance matching element comprises two horizontal parts which are parallel to each other, a vertical part which is shorter than each of the two horizontal parts and extends from one of the two horizontal part to the other in an end portion, which is not longer than 100 mm, of each of the two horizontal parts, a first extension having an end part which extends upward from a point of the upper one of the two horizontal parts and a major part which extends horizontally from the upper end of the end part to the vertical part of the primary element and a second extension having an end part which extends downward from a point of the lower one of the two horizontal parts and a major part which extends horizontally from the lower end of the end part to the vertical part of the primary element. The horizontal part of the auxilary element is connected at one end thereof to the vertical part of the primary element or a part of the impedance matching element and at the opposite end to the feed point.

In this specification the term "vertical" is used in the sense of "perpendicular to horizontal lines on the window glass". That is, a "vertical" part of any antenna element is not always literally vertical when the window glass is attached to the vehicle body.

As to the L-shaed primary element, the direction of extension of the horizontal part from the vertical part is not limited. That is, it is optional whether or not to locate the impedance matching element and the horizontal part of the primary element on the same side of the vertical part of the primary element.

As to the impedance matching element, it is optional to add another vertical element which connects the two horizontal parts to each other in another end portion, which is not longer than 100 mm, of each of the two horizontal parts, and in that case the two horizontal parts and the two vertical parts may be arranged so as to make the perimeter of a horizontally elongate rectangle. Also it is optional to add a supplementary part which extends from an end of one of the two horizontal parts and may bend so as to extend horizontally between the two horizontal parts.

The essential elements of an antenna according to the invention are as stated above, and in many cases it is not necessary to add any extra element for the reception of both FM radio broadcasting and TV broadcasting. However, it is optional to incorporate a supplementary element or a plurality of supplementary elements for the purpose of adjusting the impedance of the antenna, improving the directional characteristics of the antenna and/or making capacitive coupling of the antenna with the defogging heater strips. It is possible to connect a supplementary element to either the primary element or the auxiliary element, and each supplementary element may be either straight or bent at right angles.

A vehicle rear window glass antenna according to the invention can be constructed in a relatively narrow area left above the defogging heater strips, and this antenna serves as a wide-band antenna which can receive FM radio broadcast waves in a 76–108 MHz band, which includes the FM radio broadcasting band used mainly in Japan and the FM radio broadcasting band used in many other countries including the United States and Canada, and TV broadcast waves in both the VHF band (90–108 MHz and 170–222 MHz) and the UHF band (470–770 MHz) with satisfactory high reception gains. The invention is very suitable for application to automobiles.

DESCRIPTION OF THE PREFERRED EMBODIMENTS

Figure 1:
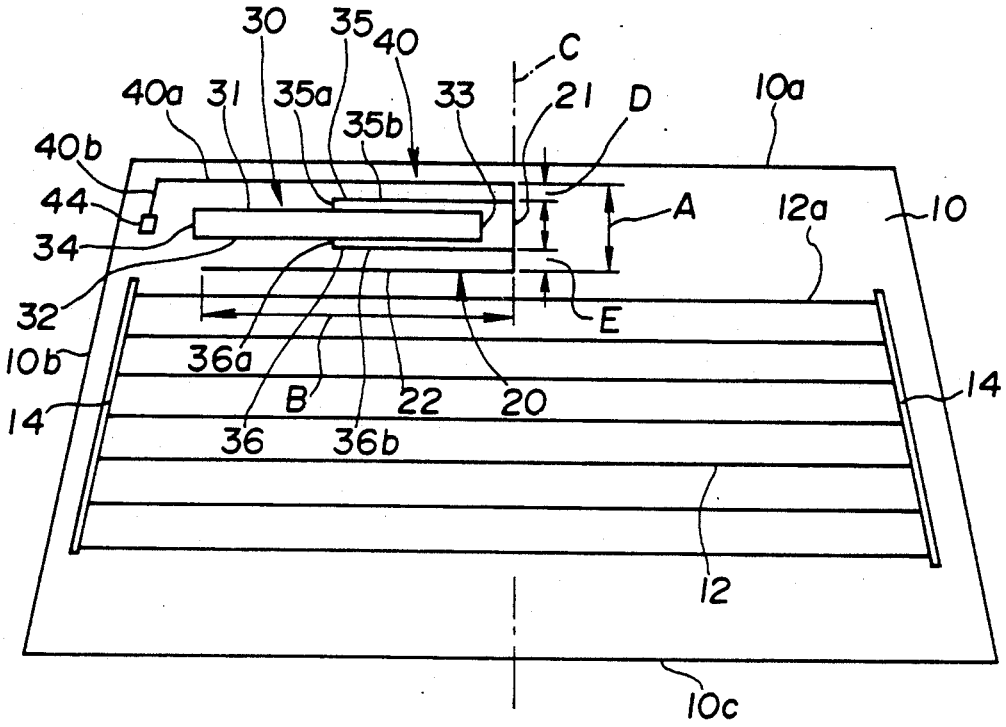
FIG. 1 is a plan view of an automobile rear window glass provided with an antenna according to the invention in a space above defogging heater strips.

FIG. 1 shows an automobile rear window glass in which the present invention is embodied. A single piece of glass plate 10 is used as the window glass. A set of defogging heater strips 12 is disposed on the inboard surface of the window glass so as to leave an open space between the upper edge 10*a* of the glass and the uppermost heater strip 12*a*. The heater strips 12 extend horizontally and connect with a pair of bus bars 14.

Using the space above the heater strips 12 an antenna according to the invention is disposed on the inboard surface of the window glass 10. Essentially the antenna is a combination of a primary element 20, an impedance matching element 30 and an auxiliary element 40, and every element of the antenna is a linear element made of a thin, conductive strip. A feed point 44 is positioned in an upper corner region of the window glass 10 at a short distance from a side edge 10*c* of the window glass, and the antenna is connected to the feed point 44 at one end of the auxiliary element 40.

The primary element 20 is an L-shaped element having a vertical part 21, which extends approximately on the vertical center axis C of the window glass 10, and a horizontal part 22 which extends from the lower end of the vertical part 21 toward a side edge 10*b* of the window glass.

For the function of the primary element 20 the horizontal part 22 is more important than the vertical part 21. It is suitable that the length B of the horizontal part 22 is from 300 to 600 mm, and preferably from 400 to 550 mm. The vertical part 21 is always located in a widthwise central region of the window glass 10, but the vertical part 21 is not necessarily exactly on the center axis C of the window glass. That is, the vertical part 21 may be located on either side of the center axis C, and its horizontal distance from the center axis C may reach about 50 mm. It is suitable that the length A of the vertical part 21 is from 60 to 120 mm, and preferably from 80 to 100 mm.

According to the type of the car it is optional to connect a supplementary element to the horizontal part 22 of the primary element 20, as will be illustrated hereinafter.

The main part of the impedance matching element 30 in FIG. 1 bends so as to make the perimeter of a horizontally elongate rectangle. That is, this element 30 has two parallel horizontal parts 31 and 32 and two parallel vertical parts 33 and 34. Besides, this element 30 includes two extensions 35 and 36 both of which connect to the vertical part 21 of the primary element 20. The extension 35 extends upward from a middle point of the horizontal part 31 so as to make a short vertical part 35*a* and bends toward the center axis C of the window glass so as to make a horizontal part 35*b* which reaches the vertical part 21 of the element 20. The extension 36 extends downward from a middle point of the horizontal part 32 so as to make a short vertical part 36*a* and then bends toward the center axis C so as to make a horizontal part 36*b* which reaches the vertical part 21 of the element 20.

The two horizontal parts 31 and 32 are indispensable to the impedance matching element 30, but one of the two vertical parts 33 and 34 can be omitted. That is, it suffices to connect the two horizontal parts 31 and 32 to each other by a vertical part. The main purpose of the two extensions 35 and 36 is to connect the two horizontal parts 31 and 32 to the vertical part of 21 of the element 20, respectively, but these extensions 35, 36 also make some contributiton to the impedance matching function of the element 30. It is suitable that the length of the horizontal parts 31, 32 is from 200 to 500 mm, and preferably from 250 to 450 mm, and that the length of the vertical parts 33, 34 is from 10 to 50 mm, and preferably from 20 to 40 mm. The vertical part 33 is at one end of each horizontal part 31, 32 or at a horizontal distance not longer than 100 mm from that end of each horizontal part 31, 32. The same applies to the other vertical part 34. It is preferable that each of the two extensions 35 and 36 extends approximately from the middle of the horizontal part 31, 32, but this is not an indispensable requisite. Naturally the horizontal length of each extension 35, 36 depends on the position of its vertical part 35*a*, 35*b*. The two extensions 35 and 36 may be different in horizontal length.

A main part 40*a* of the auxiliary element 40 extends horizontally from the upper end of the vertical part 21 of the primary element 20 and reaches the upper corner region of the window glass 10 where the feed point 44 is positioned, and a short extension part 40*b* connects the extended end of the main part 40*a* to the feed point 44. The main, horizontal part 40*a* is located above the impedance matching element 30. It is suitable that the length of the horizontal part 40*a* is from 400 to 800 mm, and preferably from 500 to 700 mm. It is possible, particularly when the horizontal part 40*a* is relatively short, to connect this part 40*a* to the extension 35 or a different part of the impedance matching element 30 instead of connecting to the vertical part 21 of the primary element 20. When the horizontal part 40*a* is relatively long it is possible to supplement this part 40*a* with a turn-back part to connect an end of the part 40*a* to the vertical part 21 of the primary element, as will be illustrated hereinafter.

Usually the heater strips 12, bus bars 14, all the antenna elements and the feed point 44 are formed by printing a conductive paste onto the glass surface and, after drying, baking the glass plate with the printed paste thereon. In the case of the rear window glass using laminated glass it is also possible to embed the antenna according to the invention in the laminated glass, and in that case it is optional to sandwich the antenna between two plastic interlayers by using a thin metal wire or foil as the material of the antenna elements.

In a sample of the window glass of FIG. 1 the glass plate 10 was 1150 mm in the length of the upper edge 10*a*, 1460 mm in the length of the lower edge 10*c* and 740 mm in the length perpendicular to the upper and lower edges 10*a*, 10*c*, and the dimensions of and relating to the antenna elements were as follows.

The L-shaped primary element 20 was 100 mm in the length A of the vertical part 21 and 500 mm in the length B of the horizontal part 22. The upper end of the vertical part 21 was at a vertical distance of 20 mm from the upper edge 10*a* of the glass, and the horizontal part 22 was at a vertical distance of 20 mm from the uppermost heater strip 12*a*. The impedance matching element 30 was 450 mm in the length of the horizontal parts 31, 32 and 35 mm in the length of the vertical parts 33, 34. The auxiliary element 40 was 560 mm in the length of the horizontal part 40*a*. The vertical distance D of the extension 35 of the impedance matching element 30 from the auxiliary element 40 was 20 mm, and the vertical distance E of the extension 36 from the horizontal part 22 of the primary element 20 was 25 mm.

With this sample, the gains of the antenna in receiving FM radio broadcast waves in the 76–108 MHz band, TV broadcast waves of Nos. 1 to 12 channels in the VHF band (90–108 MHz and 170–222 MHz) and TV broadcast waves in the UHF band (470–770 MHz) were measured with respect to horizontally polarized waves and compared with the gains of a standard dipole antenna. That is, for any frequency or channel the gain of the dipole antenna was taken as the basis, 0 dB, and the gain of the sample antenna was marked on this basis. As the result, the gain of the sample antenna was −16.1 dB on an average in the FM radio band, −18.8 dB on an average in the VHF band and −18.2 dB on an average in the UHF band. Considering that a good example of conventional rear window glass antennas exhibited an average gain (vs. standard dipole antenna) of about −19 dB in the FM radio band, about −20 dB in the VHF band and about −19 dB in the UHF band, the antenna of FIG. 1 is judeged to be a better antenna for the reception of either FM radio broadcast waves or TV broadcast waves in the VHF and UHF bands.

Figure 2:
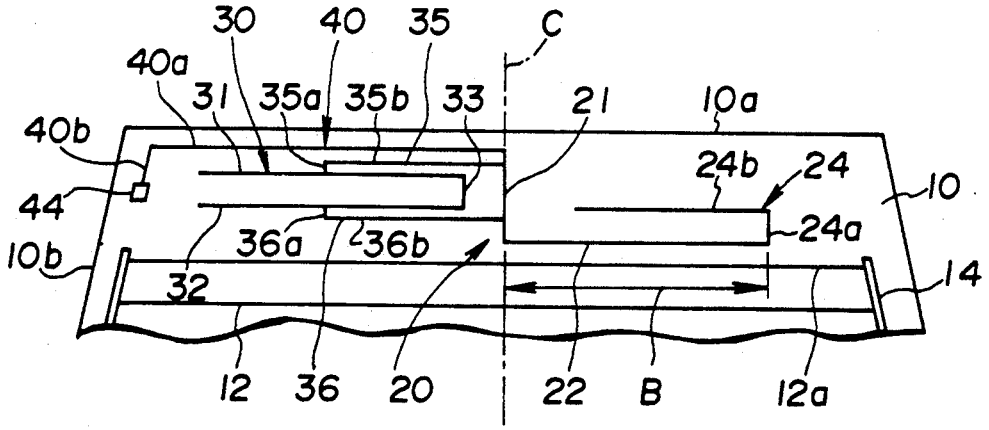
FIGS. 2 and 4 respectively show two different modifications of the antenna in FIG. 1, each modification including reversely orienting the L-shaped main element.

As shown in FIGS. 1 and 2, the direction of extension of the horizontal part 22 of the L-shaped primary element 20 is not limited. In FIG. 1 the horizontal part 22 and the impedance matching element 30 are located on the same side of the vertical part 21 of the element 20, but in FIG. 2 the horizontal part 22 is on the opposite side.

Besides the reversed orientation of the primary element 20, FIG. 2 shows the following modifications of the antenna in FIG. 1. The impedance matching element 30 has only one vertical part 33 to connect the two horizontal parts 31 and 32 to each other, and the antenna includes a supplementary element 24 which is connected to the horizontal part 22 of the primary element 20. The supplemenatary element 24 extends upward from the extended end of the horizontal part 22 so as to make a short vertical part 24*a* and bends toward the vertical part 21 of the element 20 so as to make a horizontal part 24*b*. Whenever a supplementary element of this type is employed, the length of the horizontal part 24*b* is limited so as not to reach the vertical part 21 of the primary element 20. It is suitable that the length of this horizontal part 24*b* is from 100 to 500 mm, and preferably from 200 to 350 mm.

In a sample of the window glass of FIG. 2, the length B of the horizontal part 22 of the primary element 20 was 400 mm, and the supplementary element 24 was 30 mm in the length of the vertical part 24*a* and 300 mm in the length of the horizontal part 24*b*. Otherwise the dimensions of the window glass 10 and the antenna elements were the same as in the sample of the window glass of FIG. 1. By the test described hereinbefore, average gains (vs. standard dipole antenna) of the sample antenna were −15.2 dB in the FM radio band, −18.6 dB in the VHF TV band and −18.4 dB in the UHF TV band. That is, the antenna of FIG. 2 is equivalent to, or somewhat better than the antenna of FIG. 1.

Figure 3:
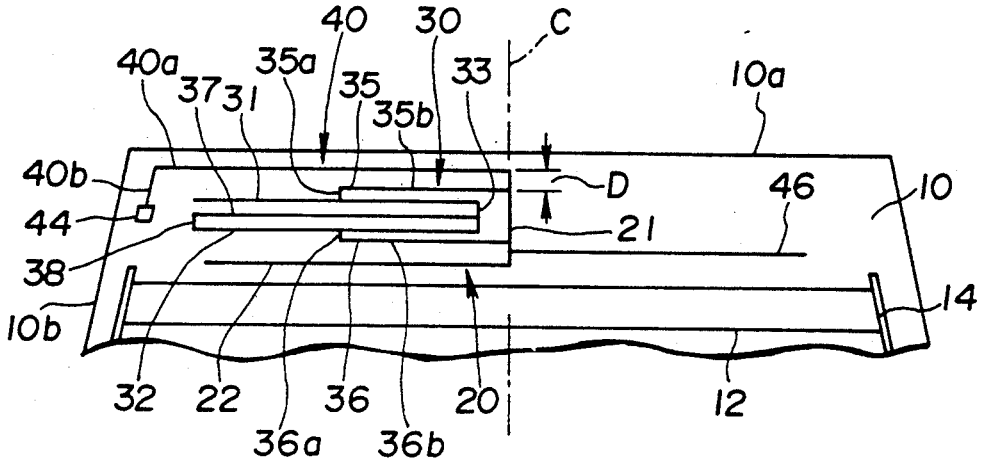
FIGS. 3 and 5 respectively show two still different modifications of the antenna in FIG. 1.

In FIG. 3, the antenna of FIG. 1 is modified in the following points. The vertical part 34 of the impedance matching element 30 is omitted, and the impedance matching element 30 is supplemented with another horizontal part 37 which extends between the two horizontal parts 31 and 32 from an approximately middle point of the vertical part 33 and a short vertical part 38 which connects the extended end of the horizontal part 37 to the end of the lower horizontal part 32. Further, the antenna includes a second auxiliary element 46, which is a horizontal element extending from the vertical part 21 of the primary element 20 in the direction reverse to the horizontal part 22 of the element 20.

In a sample of the antenna of FIG. 3 the dimensions of the window glass 10 and the antenna elements were the same as in the sample of the antenna of FIG. 1, except that the length of the vertical part 33 of the impedance matching element 30 was shortened to 30 mm, that the vertical distance D of the auxiliary element 40 from the extension 35 of the impedance matching element 30 was widened to 25 mm and that the second auxiliary element 46 was 450 mm long. By the test described hereinbefore, average gains (vs. standard dipole antenna) of the sample antenna were −15.1 dB in the FM radio band, −18.7 dB in the VHF TV band and −17.9 dB in the UHF TV band. That is, in any of the tested bands the antenna of FIG. 3 was higher in reception gain than the antenna of FIG. 1.

Figure 4:
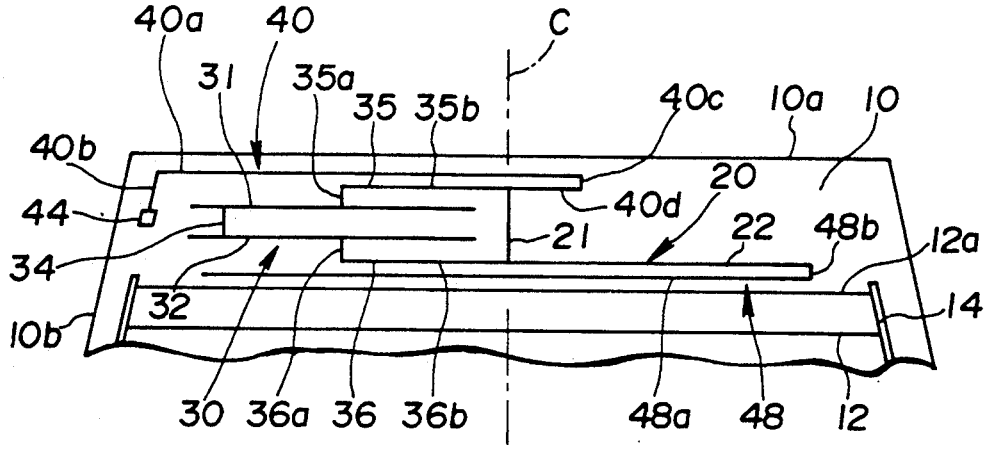

In FIG. 4, the antenna of FIG. 1 is modified in the following points. Regarding the primary element 20 the direction of the horizontal part 22 is reversed without changing the length. A second auxiliary element 48 is connected to the primary element 20. The auxiliary element 48 has a long horizontal part 48*a*, which extends between the horizontal part 22 of the primary element 20 and the uppermost heater strip 12*a*, and a short vertical part 48*b* which extends from an end of the horizontal part 48*a* to the extended end of the horizontal part 22 of the element 20. Regarding the impedance matching element 30 only one vertical part 34 is used to connect the two horizontal parts 31 and 32 to each other, and this vertical part 34 is at a horizontal distance of 50 mm from the left end (remote from the center axis C of the window glass) of each horizontal part 31, 32. Regarding the first auxiliary element 40 the horizontal part 40*a* is made longer than in FIG. 1 so as to extend at a level above the upper end of the vertical part 21 of the primary element 20, and the extended end of the horizontal part 40*a* is connected to the upper end of the vertical part 21 of the element 20 by a supplementary vertical part 40*c* and a supplementary horizontal part 40*d*.

Figure 5:
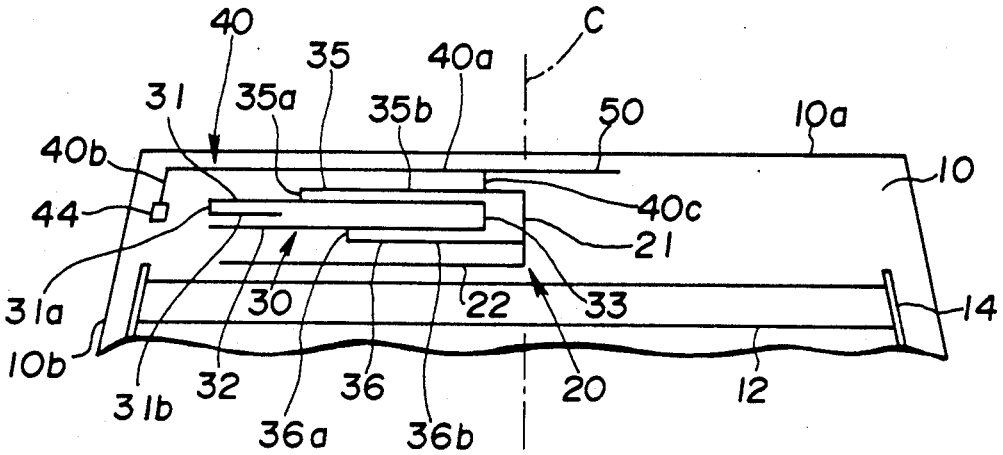

In FIG. 5, the antenna of FIG. 1 is modified in the following points. Regarding the impedance matching element 30 only one vertical part 33 is used to connect the two horizontal parts 31 and 32 to each other, and the upper horizontal part 31 is supplemented with a short vertical part 31*a* which extends downward from the free end of the horizontal part 31 and a short horizontal part 31*b* which extends from the lower end of the vertical part 31*a* toward the center axis C. Besides, the upper extension 35 is made longer than the lower extension 36 by shifting the position of the vertical part 35*a*. Regarding the auxiliary element 40 the horizontal part 40*a* is slightly shortened, and a short vertical part 40*c* is used to connect the horizontal part 40*a* to the upper extension 35 of the impedance matching element 30. Besides, the antenna includes another auxiliary element 50 which extends horizontally from the auxiliary element 40 in the manner of a straight extension of the horizontal part 40*a*.

The antennas of FIGS. 4 and 5 proved to be nearly equivalent to the antenna of FIG. 1 with respect to reception gains for FM radio and TV (VHF and UHF) broadcast waves.

A window glass antenna according to the invention is fully practicable by itself. However, it is optional, and rather preferable in some cases, to construct a diversity antenna system for the reception of FM radio broadcasting and TV broadcasting by combining an antenna according to the invention with another window glass antenna, which may be provided to the rear window by utilizing the space below the heater strips or another window of the vehicle, or a conventional antenna such as a pole antenna.

What is claimed is:

1. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a primary element which is an L-shaped element having a vertical part which is positioned in a widthwise central area of said space and a horizontal part which extends from the lower end of said vertical part;

an impedance matching element consisting of two horizontal parts which are parallel to each other and located in an area between said vertical part of said primary element and a side edge of the window glass, at least one and not more than two vertical parts each of which is shorter than each of said two horizontal parts and extends from one of said two horizontal parts to the other in an end portion, which is not longer than 100 mm, of each of said two horizontal parts, a first extension having an end part which extends upward from a point of the upper one of said two horizontal parts and a major part which extends horizontally from the upper end of said end part to said vertical part of said primary element and a second extension having an end part which extends downward from a point of the lower one of said two horizontal parts and a major part which extends horizontally from the lower end of the end part to said vertical part of said primary element;

an auxiliary element comprising a horizontal part which extends above said impedance matching element from said central area to a marginal area contiguous to said side edge of the window glass and is connected at one end thereof to said vertical part of said primary element; and a feed point located in said marginal area, the antenna being connected to said feed point at the opposite end of said horizontal part of said auxiliary element.

2. An antenna according to claim 1, wherein said vertical part of said primary element extends approximately on a vertical center axis of the window glass.

3. An antenna according to claim 1, wherein said vertical part of said primary element is at a horizontal distance not greater than 50 mm from a vertical center axis of the window glass.

4. An antenna according to claim 1, wherein said impedance matching element further comprises another vertical part which extends from one of said two horizontal parts to the other in another end region, which is not longer than 100 mm, of each of said two horizontal parts.

5. An antenna according to claim 4, wherein said two horizontal parts, said vertical part and said another vertical part of said impedance matching element are arranged so as to make the perimeter of a horizontally elongate rectangle.

6. An antenna according to claim 1, wherein said impedance matching element and said horizontal part of said primary element are located on the same side of said vetical part of said primary element.

7. An antenna according to claim 1, wherein said impedance matching element and said horizontal part of said primary element are located on the opposite sides of said vertical part of said primary element, respectively.

8. An antenna according to claim 1, wherein said vertical part of said first extension extends from an approximately middle point of the upper horizontal part of said impedance matching element.

9. An antenna according to claim 1, wherein said vertical part of said second extension extends from an approximately middle point of the lower horizontal part of said impedance matching element.

10. An antenna according to claim 9, wherein said vertical part of said first extension extends from an approximately middle point of the upper horizontal part of said impedance matching element.

11. An antenna according to claim 1, wherein said horizontal part of said auxiliary element is directly connected at said one end thereof to the upper end of said vertical part of said primary element.

12. An antenna according to claim 1, wherein said horizontal part of said auxiliary element is connected to said major part of said first extension of said impedance matching element.

13. An antenna according to claim 1, wherein said auxiliary element further comprises a supplementary part which extends from said one end of said horizontal part of the auxiliary element and bends so as to connect to said vertical part of said primary element.

14. An antenna according to claim 1, wherein said primary element is 60 to 120 mm in the length of the vertical part and 300 to 600 mm in the length of the horizontal part.

15. An antenna according to claim 14, wherein said impedance matching element is 200 to 500 mm in the length of each of said two horizontal parts and 10 to 50 mm in the length of the vertical part connecting the two horizontal parts to each other.

16. An antenna according to claim 15, wherein said horizontal part of said auxiliary element has a length of 400 to 800 mm.

17. An antenna according to claim 1, wherein said one end of said horizontal part of said auxiliary element is on said vertical part of said primary element.

18. An antenna according to claim 1, wherein said one end of said horizontal part of said auxiliary element is on said impedance matching element wherein the horizontal part of the auxiliary element is connected to said vertical part of said primary element by a portion of said first extension of said impedance matching element.

19. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a primary element which is an L-shaped element having a vertical part which is positioned in a widthwise central area of said space and a horizontal part which extends from the lower end of said vertical part;

an impedance matching element consisting of two horizontal parts which are parallel to each other and located in an area between said vertical part of said primary element and a side edge of the window glass, at least one and not more than two vertical parts each of which is shorter than each of said two horizontal parts and extends from one of said two horizontal parts to the other in an end portion, which is not longer than 100 mm, of each of said two horizontal parts, a first extension having an end part which extends upward from a point of the upper one of said two horizontal parts and a major part which extends horizontally from the upper end of said end part to said vertical part of said primary element and a second extension having an end part which extends downward from a point of the lower one of said two horizontal parts and a major part which extends horizontally from the lower end of the end part to said vertical part of said primary element;

an auxiliary element comprising a horizontal part which extends above said impedance matching element from said central area to a marginal area contiguous to said side edge of the window glass and is connected at one end thereof to said vertical part of said primary element; and a feed point located in said marginal area, the antenna being connected to said feed point at the opposite end of said horizontal part of said auxiliary element; and a supplementary element which extends horizontally from said vertical part of said primary element.

20. An antenna according to claim 19, wherein said supplementary element and said impedance matching element are located on the opposite sides of said vertical part of said primary element, respectively.

21. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a primary element which is an L-shaped element having a vertical part which is positioned in a widthwise central area of said space and a horizontal part which extends from the lower end of said vertical part;

an impedance matching element consisting of two horizontal parts which are parallel to each other and located in an area between said vertical part of said primary element and a side edge of the window glass, at least one and not more than two vertical parts each of which is shorter than each of said two horizontal parts and extends from one of said two horizontal parts to the other in an end portion, which is not longer than 100 mm, of each of said two horizontal parts, a first extension having an end part which extends upward from a point of the upper one of said two horizontal parts and a major part which extends horizontally from the upper end of said end part to said vertical part of said primary element and a second extension having an end part which extends downward from a point of the lower one of said two horizontal parts and a major part which extends horizontally from the lower end of the end part to said vertical part of said primary element;

an auxiliary element comprising a horizontal part which extends above said impedance matching element from said central area to a marginal area contiguous to said side edge of the window glass and is connected at one end thereof to said vertical part of said primary element; and a feed point located in said marginal area, the antenna being connected to said feed point at the opposite end of said horizontal part of said auxiliary element; and a supplementary element which has an end part extending vertically from the extended end of said horizontal part of said primary element and a horizontal part extending from the extended end of the end part.

22. An antenna according to claim 21, wherein said impedance matching element and said horizontal part of said primary element are located on the opposite sides of said vertical part of said primary element, respectively, said horizontal part of said supplementary element extending toward said side edge of the window glass from said end part of the supplementary element.

23. An antenna according to claim 22, wherein said horizontal part of said supplementary element extends above said horizontal part of said primary element and is shorter than said horizontal part of said primary element.

24. An antenna according to claim 22, wherein said horizontal part of said supplementary element extends below said horizontal part of said primary element and is longer than said horizontal part of said primary element.

25. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a primary element which is an L-shaped element having a vertical part which is positioned in a widthwise central area of said space and a horizontal part which extends from the lower end of said vertical part;

an impedance matching element having two horizontal parts which are parallel to each other and located in an area between said vertical part of said primary element and a side edge of the window glass, a vertical part which is shorter than each of said two horizontal parts and extends from one end of one of said two horizontal parts to the other, a supplementary part which extends vertically from the opposite end of said one of said two horizontal parts toward the other of said two horizontal parts and bends so as to extend horizontally between said two horizontal parts toward said vertical part of said primary element, a first extension having an end part which extends upward from a point of the upper one of said two horizontal parts and a major part which extends horizontally from the upper end of said end part to said vertical part of said primary element and a second extension having an end part which extends downward from a point of the lower one of said two horizontal parts and a major part which extends horizontally from the lower end of the end part to said vertical part of said primary element;

an auxiliary element comprising a horizontal part which extends above said impedance matching element from said central area to a marginal area contiguous to said side edge of the window glass and is connected at one end thereof to said vertical part of said primary element; and a feed point located in said marginal area, the antenna being connected to said feed point at the opposite end of said horizontal part of said auxiliary element.

26. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a primary element which is an L-shaped element having a vertical part which is positioned in a widthwise central area of said space and a horizontal part which extends from the lower end of said vertical part;

an impedance matching element consisting of two horizontal parts which are parallel to each other and located in an area between said vertical part of said primary element and a side edge of the window glass, at least one and not more than two vertical parts each of which is shorter than each of said two horizontal parts and extends from one of said two horizontal parts to the other in an end portion, which is not longer than 100 mm, of each of said two horizontal parts, a first extension having an end part which extends upward from a point of the upper one of said two horizontal parts and a major part which extends horizontally from the upper end of said end part to said vertical part of said primary element and a second extension having an end part which extends downward from a point of the lower one of said two horizontal parts and a major part which extends horizontally from the lower end of the end part to said vertical part of said primary element;

an auxiliary element comprising a horizontal part which extends above said impedance matching element from said central area to a marginal area contiguous to said side edge of the window glass and is connected at one end thereof to said vertical part of said primary element; and a feed point located in said marginal area, the antenna being connected to said feed point at the opposite end of said horizontal part of said auxiliary element; and a supplementary element which extends horizontally from said end of said horizontal part of said auxiliary element.

* * * * *